US005816437A

United States Patent [19]

Lin

[11] Patent Number: 5,816,437

[45] Date of Patent: Oct. 6, 1998

[54] CONNECTING MECHANISM FOR BARREL

[76] Inventor: Tsong-Yow Lin, No. 57-1, Yungho St., Ta-Tu Hsiang, Taichung County, Taiwan

[21] Appl. No.: 887,628

[22] Filed: Jul. 3, 1997

[51] Int. Cl.[6] ..... B65D 8/04

[52] U.S. Cl. ..... 220/611; 220/617; 220/789; 220/790

[58] Field of Search ..... 220/615, 617, 220/789, 790, 632, 634, 801, 802, 611

[56] References Cited

U.S. PATENT DOCUMENTS

| | | | |
|---|---|---|---|
| 401,249 | 4/1889 | Burton | 220/615 |
| 2,334,817 | 11/1943 | Gerahty | 220/617 |
| 3,417,899 | 12/1968 | Brown | 220/611 |
| 3,913,774 | 10/1975 | Vajtay | 220/617 |
| 4,021,342 | 5/1977 | Schacht et al. | 220/611 |
| 4,356,926 | 11/1982 | Priestly et al. | 220/611 |
| 4,874,106 | 10/1989 | Robbins, III | 220/615 |
| 4,895,267 | 1/1990 | Karlsson | 220/615 |
| 4,982,870 | 1/1991 | Van Loon | 220/617 |

*Primary Examiner*—Stephen J. Castellano
*Attorney, Agent, or Firm*—Rosenberg, Klein & Bilker

[57] ABSTRACT

An improved connecting mechanism for barrel is provided. The barrel comprises a tubular body which defines a chime and an inner wall. The inner wall of the tubular body is provided with a plurality of fastening device adjacent to the chime of the tubular body. And a bottom which can be fixedly attached to the chime of the tubular body is provided. The peripheral of the bottom is provided with a protecting rim. An annular flange adjacent to the protecting rim is further provided such that a receiving groove is defined between the protecting rim and the annular flange. Wherein when the chime of the tubular body is inserted and retained within the receiving groove of the bottom, a fixedly and firmly engagement and connection between the fastening device and the annular flange is attained. According to the preferable embodiment of the present invention, the annular flange of the bottom can be provided with a recessed portion and the fastening device can be a plurality of ratchet hookers or a ratchet flange such that a fixedly and firmly engagement between the ratchet hookers or flange and the recessed portion can be attained.

1 Claim, 5 Drawing Sheets

CONNECTING MECHANISM FOR BARREL

FIELD OF THE INVENTION

The present invention relates to a connecting mechanism, more particularly, to an improved connecting mechanism for barrel wherein the chime of the barrel is provided with fastening device by which the bottom plate can be readily and conveniently attached thereof. The conventional machining method of forming a curled flange in the chime portion for attaching the bottom thereof can be completely replaced. By this arrangement, the manufacturing procedure can be readily simplified, the labor hours can be reduced.

DESCRIPTION OF PRIOR ART

As shown in FIG. 1, the conventional and existing barrel comprises a tubular body 10 having a curled flange 101 in the chime portion and a bottom 11 having a complementary curled flange 111 thereof. When the bottom 11 is attached to the tubular body 10, those two corresponding curled flanges 101, 111 will coupled together and then are further processed to fixedly and integrally engaged with each other. However, this conventional connecting mechanism can be concluded with the following disadvantages.

1. When the bottom 11 is disposed onto the tubular body 10, a special machining fixture and equipment shall be applied to perform this connection therebetween. The machining equipment costs much and the processing procedure are also complicated. As a result, the labor hours are increased while the throughput is not proportionally increased.

2. If the tubular body and the bottom are plated before they are integrally engaged, the plated metal layer will readily deprived during the machining process. If the plating process is performed after the tubular body and the bottom are integrally formed, an incomplete plating process will be experienced since the connecting portion between the bottom and the tubular body have many gaps or slits.

SUMMARY OF THE INVENTION

It is the objective of this invention to provide an improved connecting mechanism for the barrel by which the tubular body and the bottom can be integrally and conveniently engaged. By this arrangement, 1) the machining equipment can be readily eliminated and the bottom can be readily attached to the tubular body. On the other hand, the cost of this special machining equipment is also saved. 2) By this improved connecting mechanism, the bottom and the tubular body can be plated firstly prior than the engagement therebetween is performed. Consequently, the overall quality can be readily controlled within a certain level. As a result, an aesthetic appearance of the barrel can be attained. Most important, the processing procedures can be smoothly performed.

BRIEF DESCRIPTION OF THE DRAWINGS

In order that the present invention may more readily be understood the following description is given, merely by way of example with reference to the accompanying drawings, in which.

DETAILED DESCRIPTION OF PREFERRED EMBODIMENT

Figure 1:
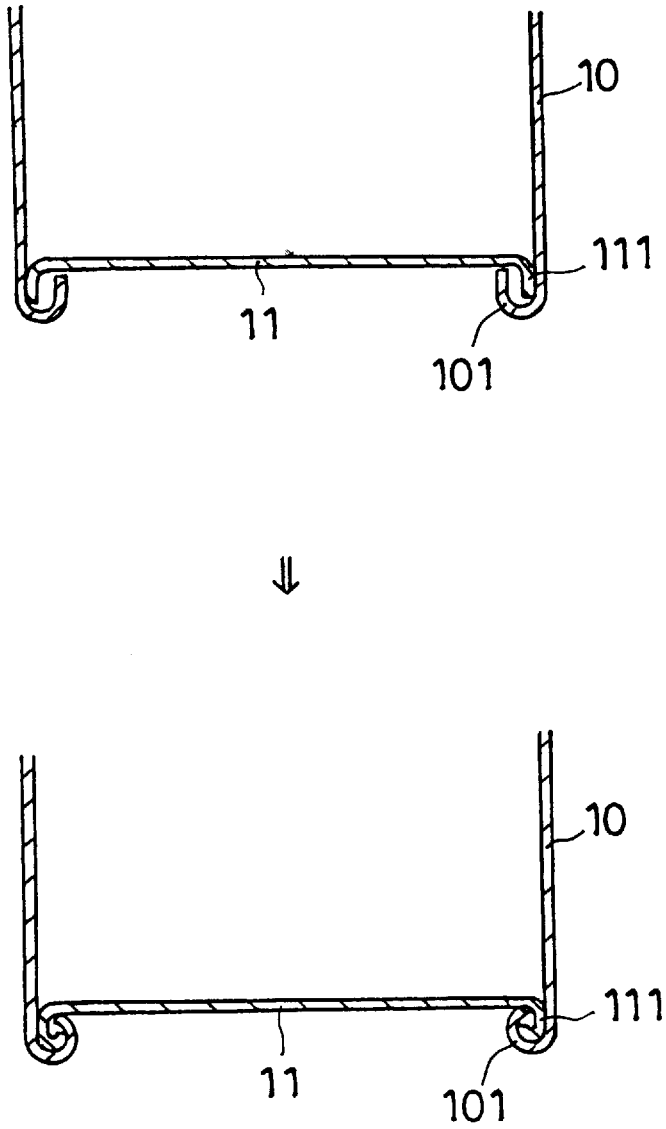
FIG.1 PRIOR ART
FIG. 1 is a cross sectional view of a conventional barrel in which the connection between the bottom and the tubular body is attained by curled flanges.
Figure 2:
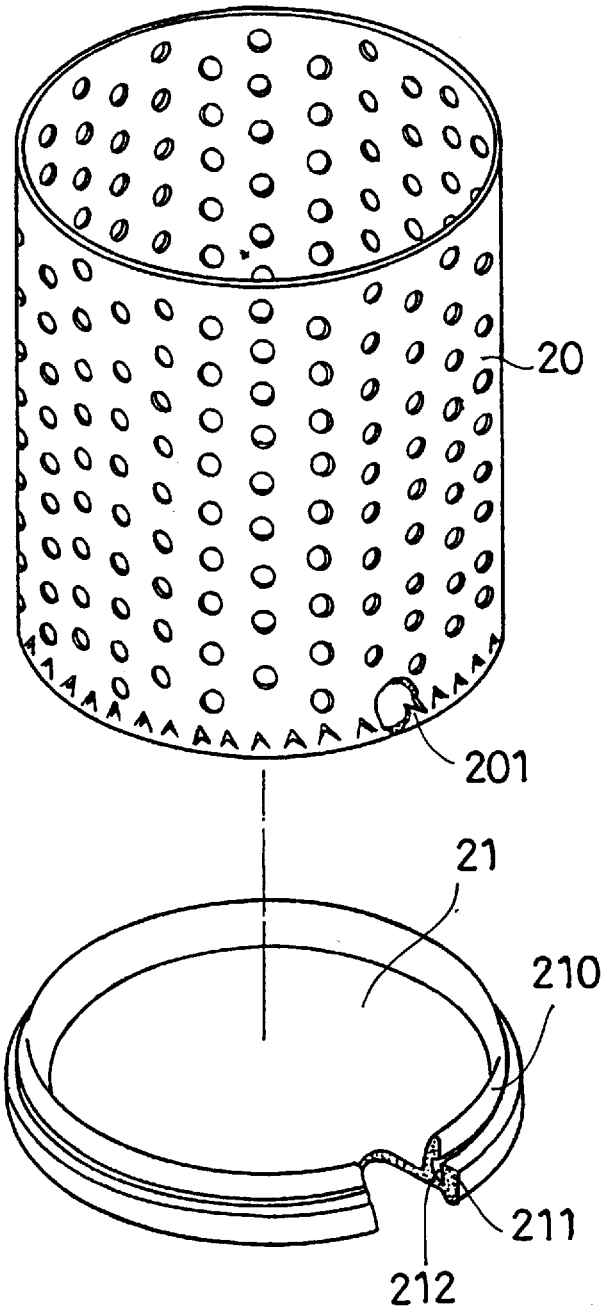
FIG. 2 is an exploded perspective view of the connecting mechanism made according to the present invention.
Figure 3:
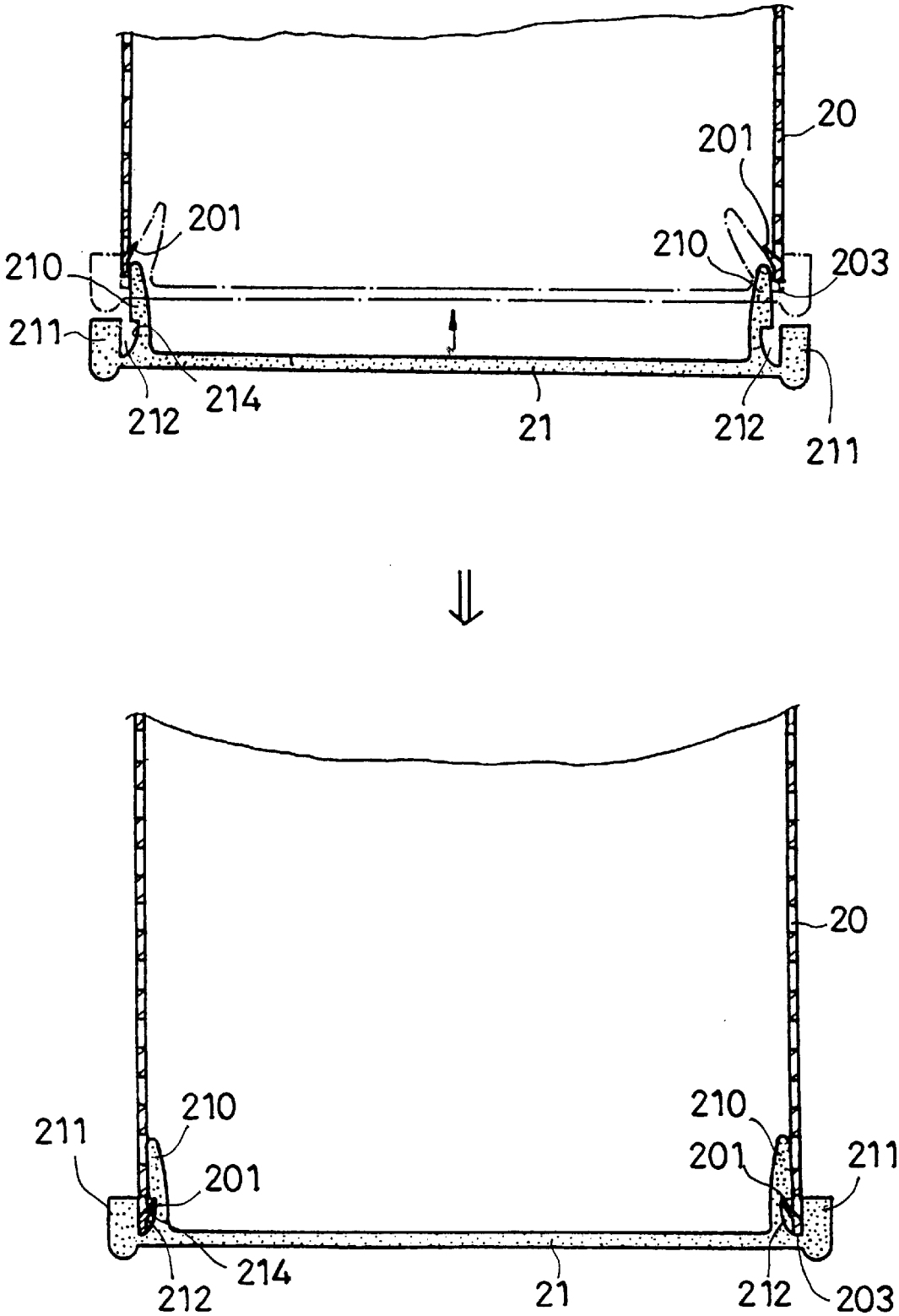
FIG. 3 is a cross sectional view of the connecting mechanism shown in FIG. 2.

Referring to FIGS. 2 and 3, the tubular body 20 and the bottom 21 are integrally engaged with each other by means of the connecting mechanism suggested by the present invention.

The tubular body 20 has a cylindrical configuration and is made from rigid material. The inner wall of the tubular body 20 adjacent to the chime 203 is provided with a plurality of ratchet hookers 201. On the other hand, the bottom 21 is made from comparative soft material, such as the plastic or rubber material or wood. The peripheral of the bottom 21 is provided with a protecting rim 211. An annular flange 210 having a recessed retaining portion is disposed on the bottom 21 adjacent to the protecting rim 211. As a result, a receiving groove 212 is jointly defined by the projecting rim 211 and the annular flange 210 which is higher than the protecting rim 211. The receiving groove 210 is specially designed such that the width of the groove 210 is equal to the thickness of the wall of the tubular body 20. By this arrangement, when the chime 203 of the tubular body 20 is inserted into the receiving groove 212 of the bottom 21, those ratchet hookers 201 will be fixedly received and retained within the receiving groove 212. Furthermore, during the inserting of the chime 203 of the tubular body 20, the ratchet hookers 201 are firstly deformed and then are completely extended after the ratchet hookers 201 are completely seated within the receiving groove 221. By this arrangement, the bottom 21 can be conveniently and integrally engaged with the tubular body 20.

The configuration, assembling and the utilization of the present invention will be detailedly described as below.

Referring to FIG. 3, after the tubular body 20 and the bottom 21 are individually manufactured, those components can be plated with a layer of metal accordingly. Afterward, during the assembling process, the chime 203 of the tubular body 20 can be firstly aligned with the receiving groove 212 of the bottom 21 and then push the tubular body 20 downward such that the chime 203 of the tubular body 20 together with the ratchet bookers 201 are completely seated within the receiving groove 21. Consequently, the bottom 21 and the tubular body 20 are integrally engaged.

In order to make the engagement more easily, the thickness of the wall of the tubular body 20 is equal the to width of the receiving groove 212. Furthermore, the tubular body 20 is made from rigid material and the bottom 21 is made from comparatively soft material such that the ratchet hookers 201 can be completely received within the recessed portion 214 of the annular flange 210 which is slightly deformed to receive the ratchet hookers 201. After the ratchet hookers 201 are completely seated within the recessed portion 214 of the annular flange 210, both the ratchet hookers 201 and the annular flange 210 will resumed to its original shape. Consequently, a fixedly and firmly engagement between the recessed portion 214 and the ratchet hookers 201 is attained therebetween.

From the forgoing description, it can be readily appreciated the following advantages from the present invention.

1. The connection and engagement between the bottom 21 and the tubular body 20 can be readily performed without a special machining equipment, as a result, a great deal of cost can be saved. On the other hand, the machining time is also largely reduced while the throughput is considerably increased.

2. The bottom 21 as well as the tubular body 20 can be individually plated before the assembling. Consequently, during the assembling process, the plated metal layer will not be deprived or negatively influenced. The resulted barrel can be provided with an aesthetic appearance.

Figure 4:
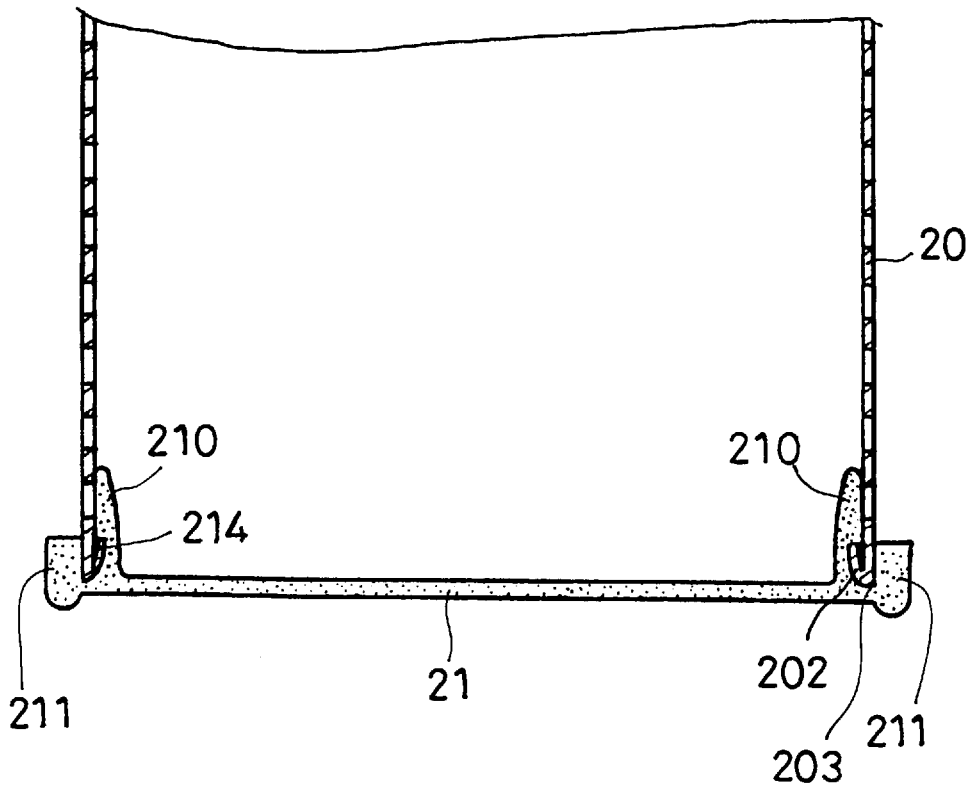
FIG. 4 is a first embodiment of the connecting mechanism made according to the present invention.

Referring to FIG. 4, in an alternative, the chime 203 of the tubular body 20 can be provided with a ratchet flange 202 which can be also completely and fixedly received within the recessed portion 214 of the annular flange 210 which the chime 203 of the tubular body 20 is inserted and received within the receiving groove 212 of the bottom 21.

Figure 5:
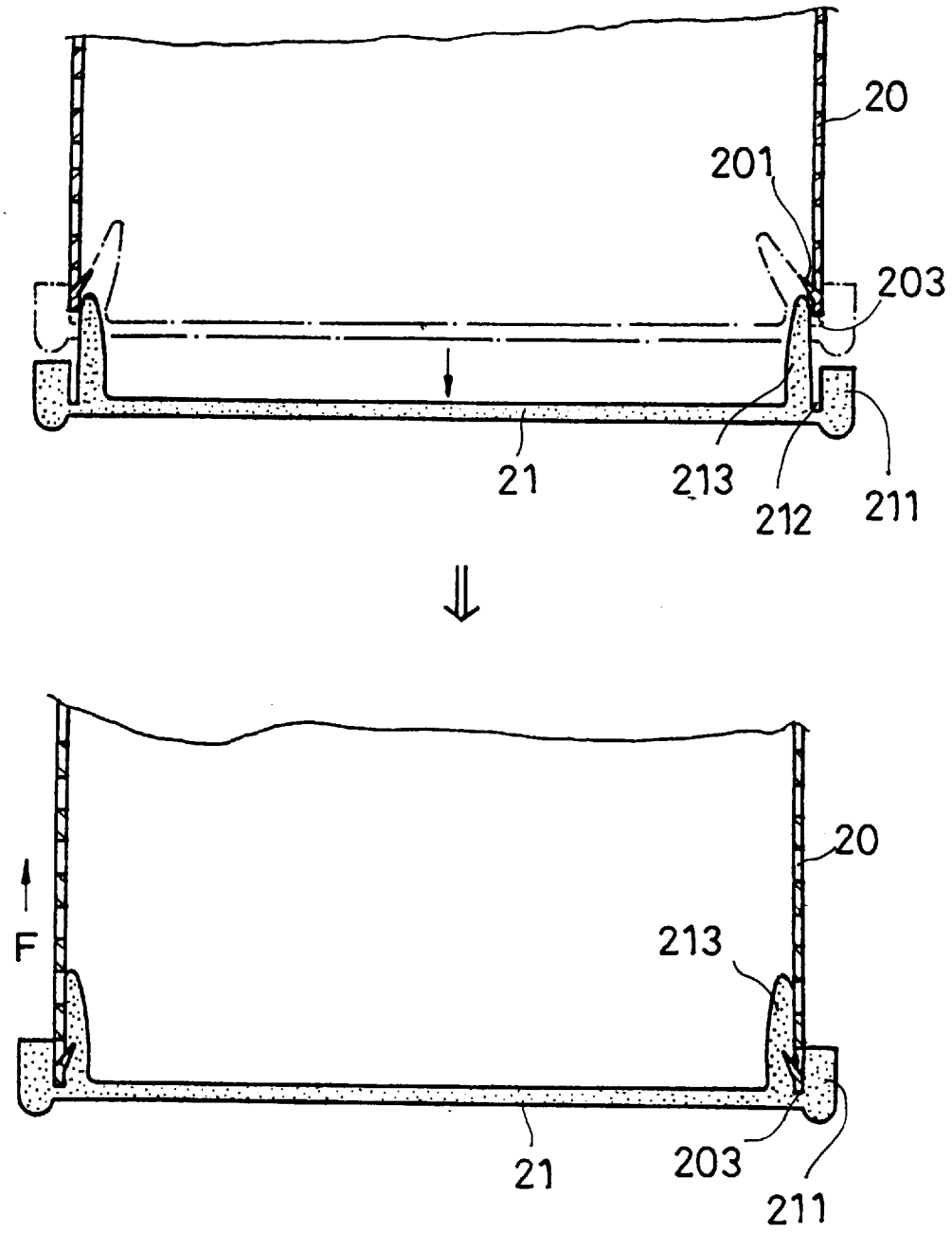
FIG. 5 is a second embodiment of the connecting mechanism made according to the present invention.

Referring to FIG. 5, the bottom 21 is provided with an annular flange 213 without a recessed portion as in the previous embodiment and is adjacent to the protecting rim 211 such that a receiving groove 212 is defined therebetween. The width of the receiving groove 212 is equal to the width of the receiving groove 212. When the chime 203 of the bottom 21 is inserted and received within the receiving groove 212, the ratchet hookers 201 can be penetrated into the annular flange 213 after it is completely seated.

From the forgoing description, it can be readily appreciated that the engagement and connection between the bottom and the tubular body can be readily and conveniently performed without any special tools or machining equipment.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A connecting mechanism for a barrel, comprising:

a tubular body formed of a rigid material, said tubular body being provided with a plurality of fastening elements on an inner wall thereof adjacent a chime of said tubular body; and, a bottom formed of a soft material and having (a) a projecting rim formed in a peripheral portion thereof, (b) an annular flange formed in said peripheral portion in spaced concentric relationship with respect to said projecting rim, and (c) a receiving groove formed between said projecting rim and said annular flange, said plurality of fastening elements fixedly and firmly engaging said annular flange to form a coupling between said tubular body and said bottom responsive to said chime of said tubular body being inserted into said receiving groove.

* * * * *